US005598978A

United States Patent [19]

Wang

[11] Patent Number: 5,598,978

[45] Date of Patent: Feb. 4, 1997

[54] GARDEN SPRINKLER HEAD WITH EXTRA DISCHARGING MEANS

[75] Inventor: King-Yuan Wang, Changhua Hsien, Taiwan

[73] Assignee: Yuan Mei Corp., Changhua Hsien, Taiwan

[21] Appl. No.: 500,682

[22] Filed: Jul. 11, 1995

[51] Int. Cl.[6] ..... B05B 1/12; B05B 1/16

[52] U.S. Cl. ..... 239/394; 239/446

[58] Field of Search ..... 239/391, 394, 239/525, 526, 443–449

[56] References Cited

U.S. PATENT DOCUMENTS

| | | | |
|---|---|---|---|
| 4,043,511 | 8/1977 | Nalcamurd | 239/394 |
| 4,303,201 | 12/1981 | Elkins et al. | 239/391 X |
| 4,534,512 | 8/1985 | Chow et al. | 239/394 |
| 4,666,085 | 5/1987 | Liaw | 239/394 |
| 4,903,897 | 2/1990 | Hayes | 239/394 |
| 5,232,162 | 8/1993 | Chih | 239/394 |

FOREIGN PATENT DOCUMENTS

| | | |
|---|---|---|
| 80210749 | 8/1991 | Taiwan . |
| 80210749 | 3/1994 | Taiwan . |

*Primary Examiner*—Kevin Weldon
*Attorney, Agent, or Firm*—Browdy and Neimark

[57] ABSTRACT

An improved sprinkler head having a top discharge cover and a water distributor plate which are integrally fixed together is rotatably mounted to a lever controlled nozzle for use in gardening or car wash. The top discharge cover has a first ring portion and a second ring portion concentrically disposed and having a plurality of fine meshes defined thereon. The top discharge cover having a number of discharge openings besides the concentric first and second ring portions is provided with a closed area which is sealedly surrounded with a section of the boundary defined in an S shape and the first ring portion is located inside and the second ring portion located outside of the closed area. The water distributor plate has a pair of outlet ports one of which is disposed in the closed area and the other is located outside thereof so that as one of the outlet ports is selectively rotated in alignment with the water outlet of the nozzle, or both the ports are brought in alignment therewith, water can be jetted from the first or second ring portion separately or both of them simultaneously.

2 Claims, 5 Drawing Sheets

GARDEN SPRINKLER HEAD WITH EXTRA DISCHARGING MEANS

BACKGROUND OF THE INVENTION

The present invention relates to an improved rotatable sprinkler head having a top discharge cover and a water distributor plate. The top discharge cover has a plurality of discharge openings and additionally provided with a first and second ring portions concentrically disposed and having a pluraltiy of fine meshes defined thereon. The top discharge cover of the sprinkler head has a closed area having a section of the boundary thereof defined in an S shape with the first ring portion located inside and the second ring portion located outside of the S shape.

The water distributor plate having two properly arranged water outlet ports works in cooperation with the top discharge cover so as to permit water to be led into only the inside of the closed area or outside thereof alternately or both thereof simultaneously when the sprinkler head is adjustably rotated.

Conventional sprinkler head as shown in the 2 related Taiwan Utility models, having the same filing numbers 8021749, are provided with a number of discharging opeings of various shapes which are selectively rotated in alignment with a water outlet so that water can be jetted in various manners, besides, a finely meshed section through which water can be sprinkled is also provided. Such sprinkler head is simple in operation and is not so dexterous in functional aspect as one expects.

SUMMARY OF THE INVENTION

The primary object of the present invention is to provide an improved sprinkler head having a top discharge cover and a water distributor plate that are welded together. The top discharge cover has a first discharge ring Portion and a second discharge ring portion that are concentrically disposed and provided with a plurality of outlet fine meshes thereon for output of water; the top discharge cover of the sprinkler head has a closed area with the first ring portion located inside and the second ring portion located outside thereof. A section of the boundary of the closed area is defined in an S shape so as to permit a pair of outlet ports disposed on a water distributor plate to be selectively located in alignment with the closed area alternatively so that by rotation of the sprinkler head, water can be discharged through one of the outlet ports or both thereof whrerby water can be discharged via the first ring portion or the second ring portion separately or simultaneously.

DETAILED DESCRIPTION OF THE PREFERRED EMBODIMENT

Figure 1:
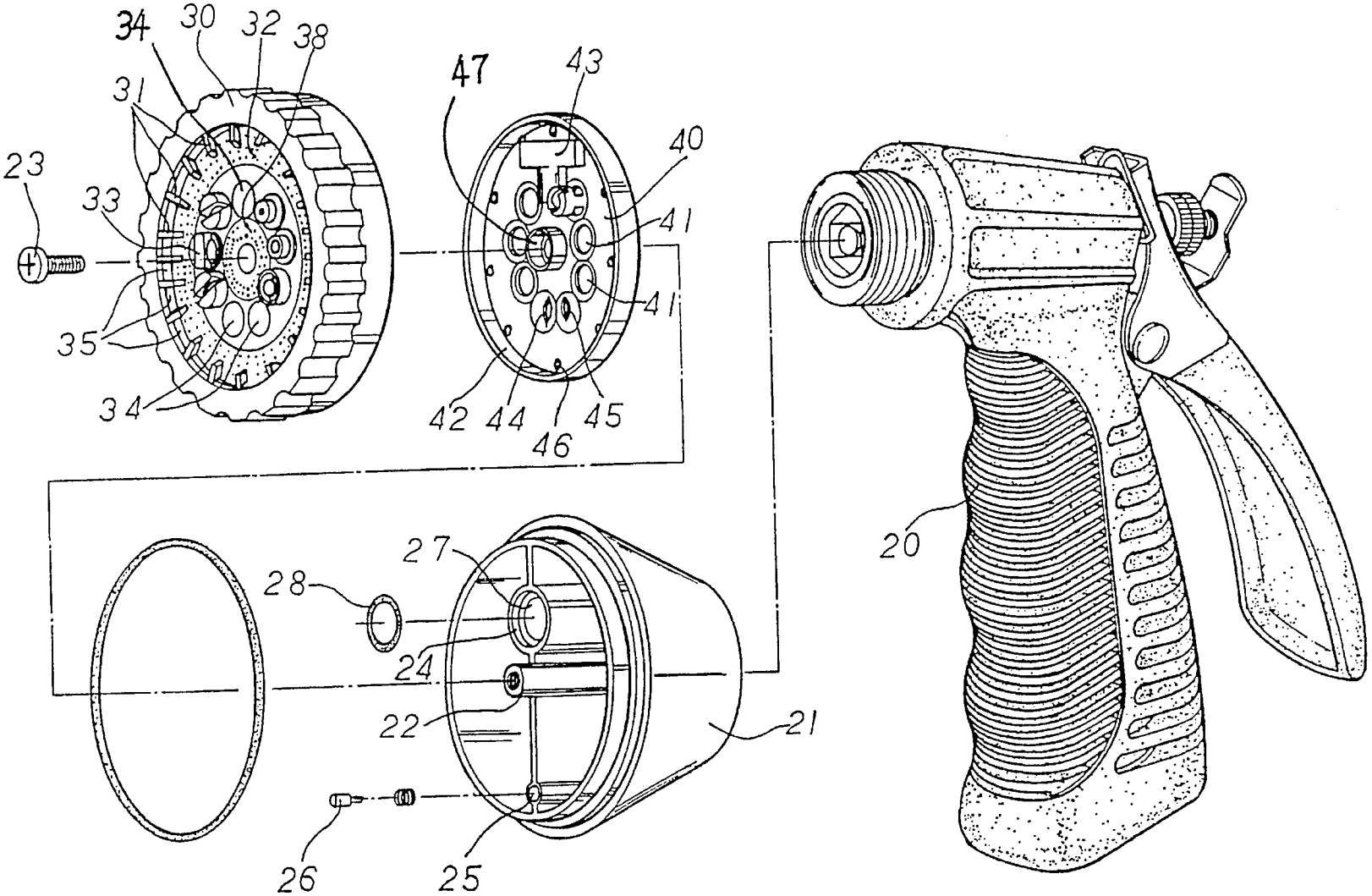
FIG. 1 is a perspective diagram showing the exploded components of the present invention.

Referring to FIG. 1, a lever controlled nozzle 20 having a nozzle head 21 removably mounted thereto. The nozzle head 21 has a water outlet 24 having a counterbored flange 27 for disposition of a sealing ring 28 and a central locking rod 22 having a threaded hole, and a receiving hole 25 in which a spring actuated locking member 26 is disposed. A sealing ring is mounted to the outer periphery of the nozzle head 21.

The sprinkler head of the present invention includes a top discharge cover 30 and a water distributor plate 40. The top discharge cover 30 has two concentrically disposed ring portions, the first ring portion 38 and the second ring portion 32 each having a plurality of fine meshes disposed thereon so as to permit water to be jetted out therethrough. In between the first and second ring portions are disposed a number of discharg openings 33 of various kinds on a circular periphery.

A plurality of radially extended water guide pieces 31 are spacedly disposed on the outer periphery of the second ring portion 32. A circular full-discharge opening 35 is placed between the outer periphery of the second ring portion 32 and the boundary of the top discharge cover 30. A number of closed round spots 34 are disposed between the discharge openings 33. A hole is disposed at the center of the top discharge cover 30 so that a screw 23 can lock the same in place to the central locking rod 22 of the nozzle head 21 by engagement with the threaded hole.

The water distributor plate 40 has a peripheral skirt 42 and is provided with a plurality of spaced detent holes 46 defined peripherally adjacent to the skirt 42. In conformance to the discharge openings 33, there are a plurality of corresponding through holes 41 positioned around a central hole 47 through which the screw 23 can be led in assembly.

Figure 3:
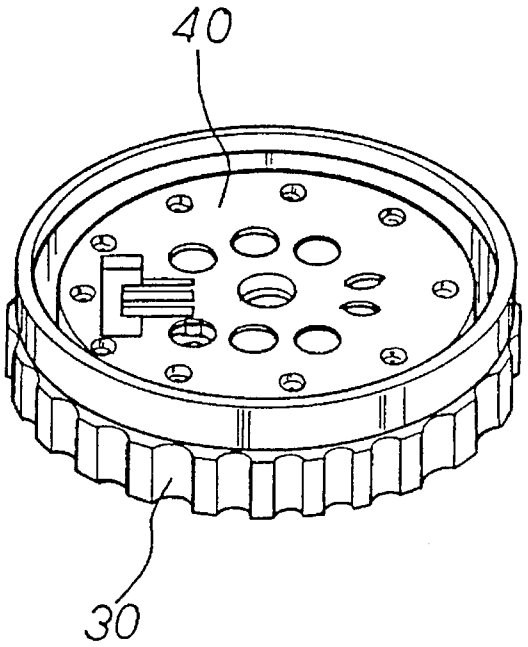
FIG. 3 is a perspective diagram showing the reverse side of the assembled sprinkler head.
Figure 2:
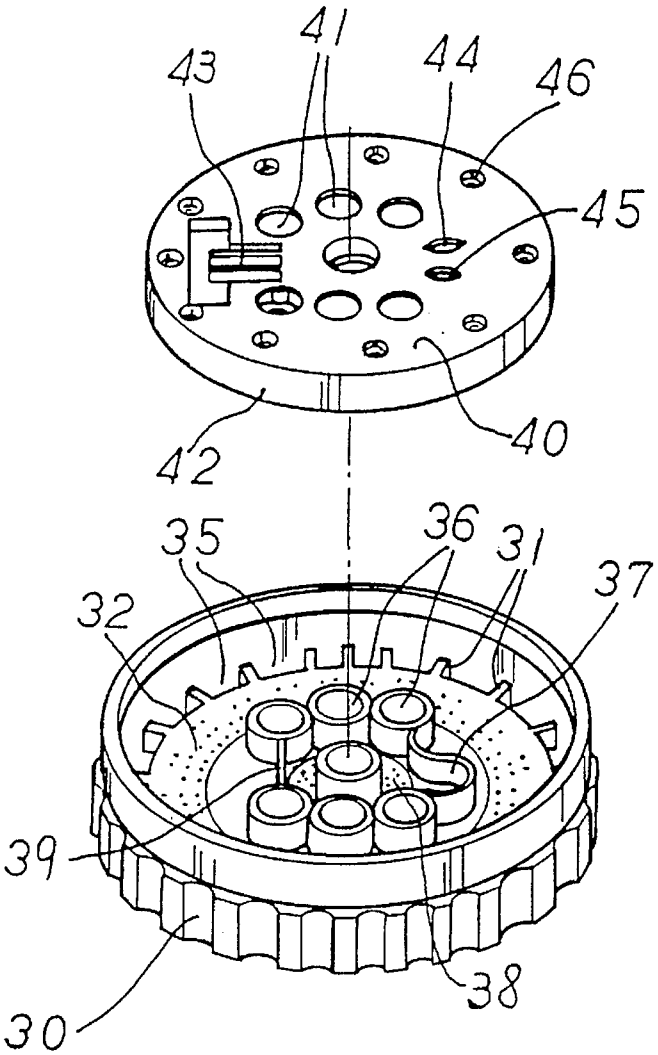
FIG. 2 is a diagram showing the reverse side of the top discharge cover and the water distributor plate of sprinkler head of the present invention.
Figure 4:
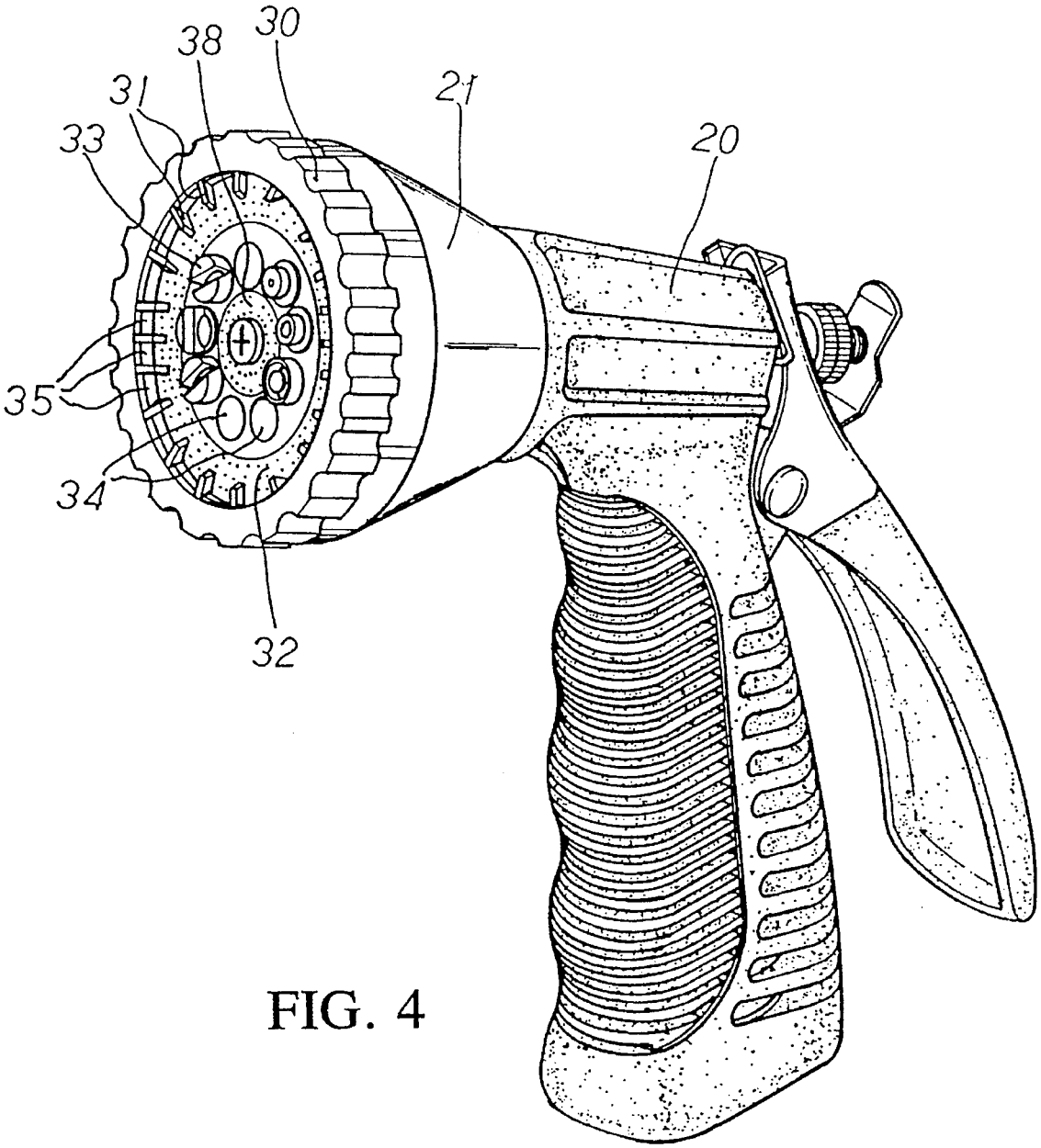
FIG. 4 is a perspective diagram showing the sprinkler of the present invention.

Referring to FIGS. 2, 3, the water distributor plate 40 is integrally secured to the rear side of the top discharge cover 30 by ultrasonic welding art. The skirt 42 is located along the outer periphery of the second ring portion 32 with the spaced water guide pieces 31 and the peripherally defined full-discharge opening 35 located outside the water distributor plate 40.

As shown in FIGS. 2, 3, each discharge opening 33 has a tubular extension 36 on the rear side thereof. The tubular extensions 36 are positioned in sealing abutment with one another. The space left between two tubular extensions 36 in correspondence to the single closed round spot 34 of the top discharge cover 30 is disposed a first wall section 39. On the rear side of the double closed round spots 34 is placed a second S-shaped wall section 37 sealedly bridging two tubular extensions 36.

A closed area is formed by the 6 tubular extensions 36 and the first wall section 39 and the second wall section 37 with the first ring portion 38 enclosed therein.

In correspondence to the first closed round spot 34 of the top discharge cover 30, a T-shaped closed member 43 having a cavity on the rear side of the water distributor plate 40 is defined, and to each of the double closed round spots 34, there are a first rhomb-shaped port 44 and a second rhomb-shaped port 45 disposed respectively. The first port 44 is slightly larger than the scond port 45.

In welding assembly, the water discharge plate 40 is secured to the top discharge cover 30 With the T-shaped closed member 43 thereof located in correspondence to the first wall section 39 and the first and second rhomb-shaped ports 44, 45 located in correspondence to the second S-shaped wall section 37 in such a manner that the larger first port 44 located outside the closed area and the second port 45 positioned inside the closed area.

The assembled top discharge cover 30 and the water distributor plate 40 is fixed to the nozzle head 21 by the screw 23. In operation, the sprinkler head having the top discharge cover 30 and the water distributor plate 40 integrally secured together can be rotated in sequence so as to permit the various discharge openings 33 and the closed round spot 34 to become in alignment with the water outlet 27 of the nozzle head accordingly whereby water can be jetted out in different manners.

Figure 5A:
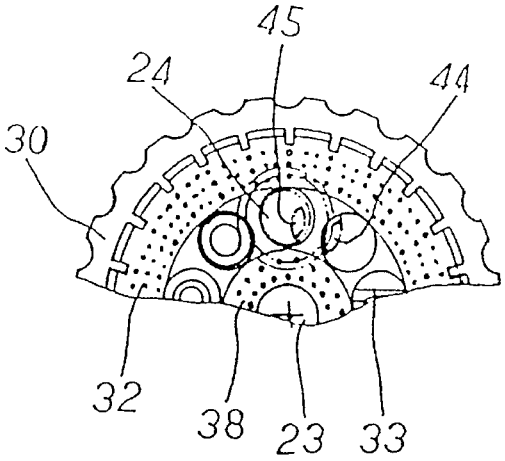
FIG. 5A is a partial front view of FIG. 5.
Figure 5:
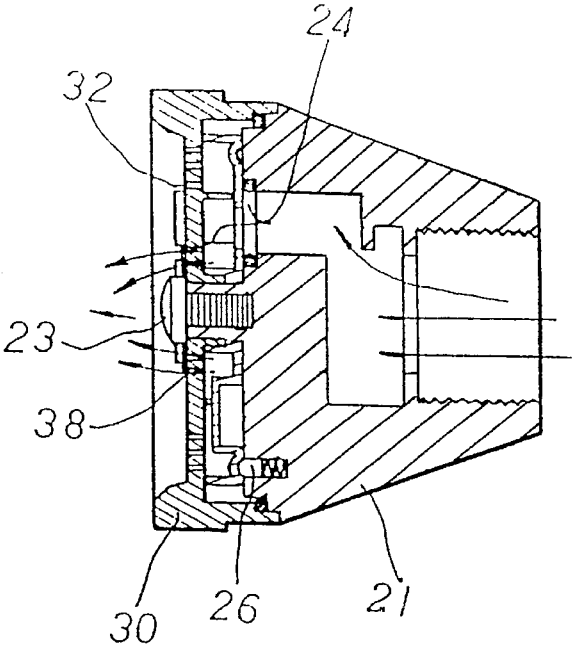
FIG. 5 is a sectional diagram showing the first mode of operation of the present invention.
Figure 7A:
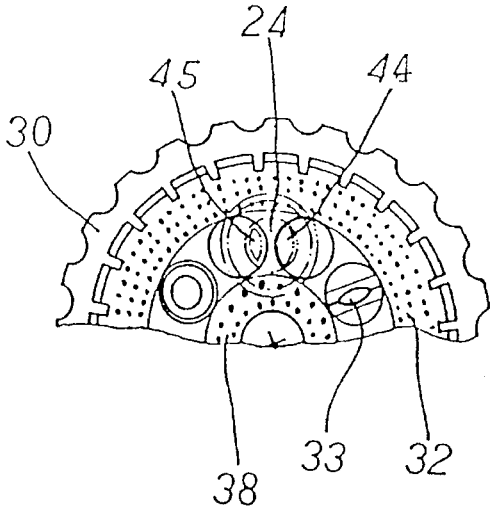
FIG. 7A is a partial front view of FIG. 7
Figure 7:
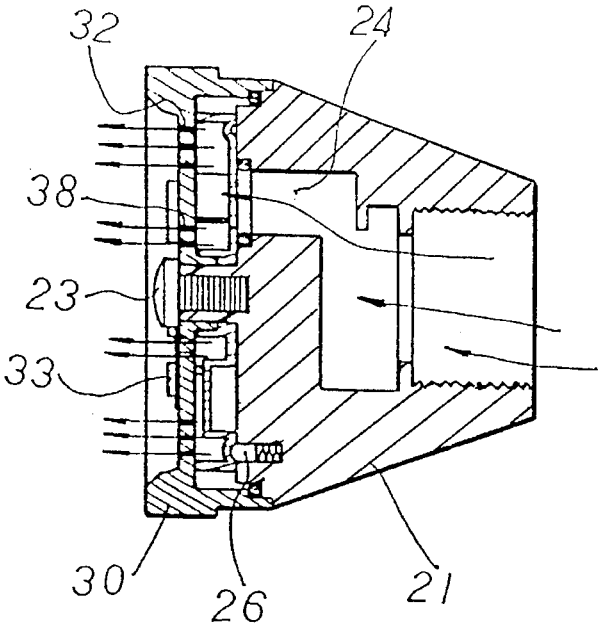
FIG. 7 is a third mode of operation thereof.
Figure 6A:
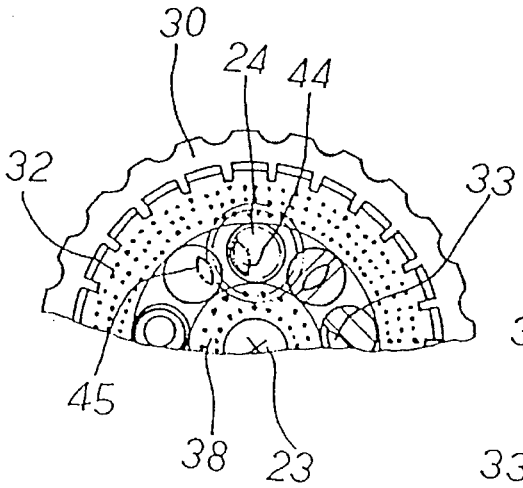
FIG. 6A is a partial front view of FIG. 6.
Figure 6:
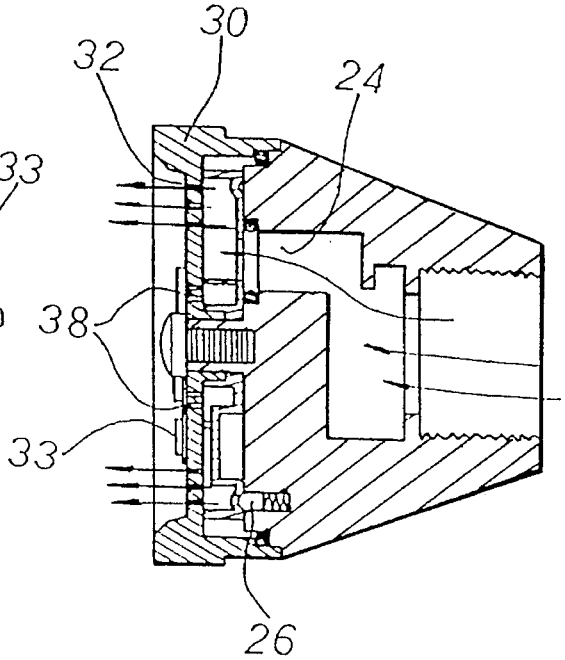
FIG. 6 is a diagram showing the second mode of operation thereof.

When the T-shaped closed member 43 is in alignment with the water outlet 27, water is discharged via the full-discharge opening 35. When the first rhomb-shaped port 44 is located in alignment with the water outlet 24, as shown in FIGS. 6 and 6A, water is led into the outside of the closed area. and is jetted via the second ring portion 32 with fine meshes. While, as shown in FIGS. 5 and 5A, as the second rhomb-shaped port 45 is brought in alignment with the water outlet 24, water is led into the closed area and is discharged via the first ring portion 38 having fine meshes. Referring to FIGS. 7 and 7A, the first and scond rhomb ports 44, 45 are positioned close enough so that both of them can be in aligment with the water outlet 24 at the same time, permitting water to be discharge via the first ring portion 38 and the second ring portion 32 simultaneously.

So, by means of the closed area and the first and second rhomb-shaped ports, and the fisrt and second ring portions 38, 32 with fine meshes, water can be discharged in three different ways in addition to normal discharges of a conventional nozzle head.

I claim:

1. A sprinkler head rotatably mounted to a nozzle head comprising:

a top discharge cover;

a water distributor plate integrally secured to said top discharge cover;

said top discharge cover having a plurality of openings for discharging water and a number of closed round spots which are arranged on a circular periphery;

said water distributor plate having a plurality of round outlets disposed in alignment with said openings and closed spots respectively;

each said opening in alignment with said round outlet respectively having a tubular extension;

said tubular extensions being disposed in sealing abutment against one another on a circular periphery with two sections thereof left opened;

a first wall section disposed between two spaced tubular extensions at one of said opened sections with a closed round spot located in association therewith at the other side of said top discharge cover;

a second wall section disposed between another two spaced tubular extensions with two closed round spots located in association therewith at the other side of said top discharge cover so that a closed area is formed by a boundary including the first and the second wall sections and the sealedly disposed tubular extensions;

a first ring portion having a plurality of fine meshes being disposed near the center of-said top discharge cover;

a second ring portion having a plurality of fine meshes disposed thereon being concentrically disposed with respect to said first ring portion;

said water distributor plate having a first outlet port and a second outlet port smaller than the former being disposed in correspondence to two consecutive closed round spots of said top discharge cover;

said first outlet port of said water distributor plate being disposed outside of said closed area and the second outlet port thereof being disposed inside of said closed area;

said first outlet port and said second outlet port being able to be put in alignment with said water outlet of said nozzle head respectively or simultaneously;

a closed T-shaped member having a cavity on the rear side of said water distributor plate being disposed in alignment with said single closed round spot of said top discharge cover;

said water distributor plate having a peripheral skirt portion and being secured to said top discharge cover with the skirt portion positioned along the outer periphery of said second ring portion;

a full-discharge opening having a plurality of radially spaced water guide pieces along the periphery thereof being disposed along the edge of said top discharge cover;

a plurality of retaining holes being peripherally disposed next to said skirt portion;

said nozzle head having a water outlet and a locking rod and a receiving hole in which a spring biased retaining means is disposed;

said retaining means being selectively engaged with one of said retaining holes when said sprinkler head is rotated in operation;

whereby water can be jetted from said second ring portion as said first outlet port of said water distributor plate is in alignment to said water outlet of said nozzle head; or water can be jetted from said first ring portion when said second outlet port is in alignment with said water outlet of said nozzle head; or water can be jetted simultaneously from both said first and second ring portions as both said outlet ports are brought in alignment with said water outlet.

2. The sprinkler head as claimed in claim 1 wherein said second wall section of said closed area is of an S shape so that said first outlet port is located outside said closed area and said second outlet port is located inside said closed area.

* * * * *